US005285620A

United States Patent [19]

Kaye et al.

[11] Patent Number: 5,285,620

[45] Date of Patent: Feb. 15, 1994

[54] APPARATUS AND METHOD FOR MANUFACTURING A COMPACT DISC HOLDER

[75] Inventors: Stephen Kaye, Eden Prairie; Peter N. Y. Pan, Minnetonka, both of Minn.

[73] Assignee: Thiele Engineering Company, Minneapolis, Minn.

[21] Appl. No.: 989,533

[22] Filed: Dec. 11, 1992

[51] Int. Cl.[5] ..... B65B 25/24; B65B 61/20

[52] U.S. Cl. ..... 53/474; 53/157; 53/238; 53/251; 53/254; 53/468

[58] Field of Search ..... 53/474, 468, 157, 155, 53/254, 238, 240, 251, 250, 249, 234, 169; 29/775, 773; 206/313, 312, 309

[56] References Cited

U.S. PATENT DOCUMENTS

| | | | |
|---|---|---|---|
| 4,150,520 | 4/1979 | Palmieri et al. | 53/234 X |
| 4,300,331 | 11/1981 | Yoshiba | 53/254 X |
| 4,551,966 | 11/1985 | Aoyagi et al. | 53/254 X |
| 4,685,277 | 8/1987 | Ilsemann | 53/254 X |
| 4,852,327 | 8/1989 | Kurkowski et al. | 53/254 X |
| 5,163,271 | 11/1992 | Pan et al. | 53/468 |
| 5,207,050 | 5/1993 | Fulkerson et al. | 53/474 |

*Primary Examiner*—James F. Coan

*Attorney, Agent, or Firm*—Hugh D. Jaeger

[57] ABSTRACT

Fully automated apparatus and method for manufacturing compact disc holders having a central rotating table about which conveyor tables, rotary tables, placers and other devices align to interdigitate and load compact discs into disc bases, to mate disc bases containing CDs to packaging sleeves, to load booklets into the packaging sleeves, and to handle, glue, fold and otherwise form a package containing CDs and booklets or literature.

15 Claims, 8 Drawing Sheets

APPARATUS AND METHOD FOR MANUFACTURING A COMPACT DISC HOLDER

CROSS REFERENCES TO CO-PENDING APPLICATIONS

This patent application is related to U.S. Ser. No. 07/820,809, filed Jan. 15, 1992, entitled "Apparatus and Method for Manufacturing Compact Disc Holders", now U.S. Pat. No. 5,163,271, issued Nov. 17, 1992, which is related to U.S. Ser. No. 820,846, filed Jan. 15, 1992, now U.S. Pat. No. 5,207,050, entitled "Apparatus and Method for Assembling Compact Disc or Media Packages", both assigned to the same assignee as the present patent application.

BACKGROUND OF THE INVENTION

1. Field of the Invention

This invention relates to apparatus for assembling a package to be used in displaying a compact disc or other media at a point of sale in stores, and for later storage in the home. The present invention also includes a process for assembly of the media package. Other media packages includes CD, ROMs, Optical ROMs, cassette tapes, laser discs or video tapes.

2. Description of the Prior Art

Compact discs ("CD") have become the medium of choice for recorded music. The compact discs have also presented packaging difficulties. A CD package has been needed which is large enough to provide adequate surface area for advertising in retail establishments, and which is large enough to discourage shoplifting.

The packaging must also be usable in the home or elsewhere for storage of the compact disc. Of course, the packaging for home storage is preferably no larger than needed to adequately store the compact disc.

In the prior art, this resulted in one storage package, such as a jewel box, for the home being overwrapped with additional disposable material to constitute the retail package. The hinged storage box is referred to as a jewel box and was usually a polymer of polystyrene which was very scratchable and very difficult to recycle. This large retail package and/or packaging was immediately thrown away by the customer, and then moved into the solid waste stream. CD packages were needed which could perform the two functions of retail display and home storage without immediately generating large amounts of solid waste. An additional problem is that the outside retail package was often made of non-biodegradable plastic and was not environmentally appropriate, especially to recycle.

The succeeding generation of compact disc packages was formed from a long rectangle of paper material, such as cardboard. A plastic compact disc holder was mounted to the cardboard. The cardboard and plastic holder had one configuration for store display and is known as Ecopak. After purchase, the customer reconfigured the plastic holder and folded the cardboard to reconfigure the package to a smaller size for home use. Therefore, none of the package was immediately thrown away. Additionally, the package could be made to employ more biodegradable paper products and olefin type polymers which are more easily recycled. This form of package posed new problems for compact disc loading on the CD package.

The present inventions is an apparatus which can quickly and efficiently assemble the plastic parts to the paper parts to create the modern style package configuration. As new formats of recording media are introduced, such as mini discs, this style of packaging will be adapted to the various sizes for CD, ROMs, laser discs, audio tapes and even video tapes.

SUMMARY OF THE INVENTION

The general purpose of the present invention is to provide an apparatus and method for manufacturing compact disc holders featuring a compact disc packager. A system of conveyor tables, rotary tables, placers and other devices align about a central table to handle, load, glue and otherwise process CDs, disc bases and sleeves into a single packaged item for subsequent sale, display and storage.

According to one embodiment of the present invention, there is provided a centrally located rotary table on a central table having a plurality of stations, two of which are input stations, one of which is a process station and the last of which is an off load station. Leading to one of the input stations is a disc base conveyor table including a disc base placer, a disc base opening mechanism, a placer and a rotary table. Another input station includes an aligned sleeve and literature conveyor table having on it a sleeve hopper, a placer, conveying trays and a glue system. A process station at one side of the rotary table includes a clip and reject station for severing the box end if required. The output station of the rotary table aligns to a central table including a main table conveyor, booklet placers, a sleeve folding mechanism, a pick and place mechanism and a discharge conveyor.

According to an alternative embodiment of the present invention, there is provided a centrally located rotary table on a central table having a plurality of stations, two of which are input stations, one of which is a final assembly station and the last of which is an off load station. Leading to one of the input stations is a disc base conveyor table including a disc base placer, a disc base opening mechanism, tab exerciser mechanisms, a servo controlled CD handling system, a placer and a rotary table. Another input station includes an aligned sleeve conveyor table having on it a sleeve hopper, a placer, and conveying trays. A compression station at one side of the rotary table is included to ensure proper gluing and over bending of disc base tabs. A glue station is also provided over the centered rotary table. The output station of the rotary table aligns to a central table including a main table conveyor, booklet placers, a sleeve folding mechanism, a reject station, a pick and place mechanism and a discharge conveyor.

One significant aspect and feature of the present invention is a fully automated apparatus for manufacturing compact disc holders.

Another significant aspect and feature of the present invention is the use of a central rotary table having a plurality of stations to which input stations, process stations and off load stations align.

Another significant aspect and feature of the present invention is a sleeve and literature conveyor table aligned to a central rotary table for the purpose of placing sleeves on the central rotary table.

A further significant aspect and feature of the present invention is a disc base opening mechanism aligned to the flow of disc bases on the disc base conveyor table.

A still further significant aspect and feature of the present invention is a compact disc spindle table and servo controlled CD handling system for placement of CDs from the compact disc spindle table to disc bases moving along the disc base conveyor table.

Yet another significant aspect and feature of the present invention is a first rotary table aligned to the disc base conveyor table and central rotary table for placement of and transfer of compact disc trays with resident CDs from the first rotary table to a sleeve on the central rotary table.

Still another significant aspect and feature of the present invention is a clip and reject station on the central rotary table.

A still further significant aspect and feature of the present invention is an off load station on the central rotary table adjacent and aligned to the off load end of the central table where CDs in a disc base and attached sleeve are moved along the off load end where a pamphlet or booklet are placed in the package.

Another significant aspect and feature of the present invention is a table off load end having a sleeve folding mechanism and a reject chute.

Another significant aspect and feature of the present invention are mechanisms for exercising and over bending of disc base tabs to remove hinge memory.

Another significant aspect and feature of the present invention is a pick and place mechanism having a lowerator for the removal of reject packaged items.

Another significant aspect and feature of the present invention is the use of sensors to detect proper alignment of a disc on a disc base spindle.

Another significant aspect and feature of the present invention is the use of compression station to ensure tab positioning and proper gluing.

Another significant aspect and feature of the present invention is the use of a compression station to overbend tabs in the disc base.

Another significant aspect and feature of the present invention is the use of sleeve fold mechanisms where the sleeve fold is started by one mechanism and completed by another mechanism.

Having thus described the embodiments of the present invention, it is a principal object hereof to provide a fully automated apparatus and method for manufacturing of compact disc holders.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DESCRIPTION OF THE PREFERRED EMBODIMENTS

Figure 1:
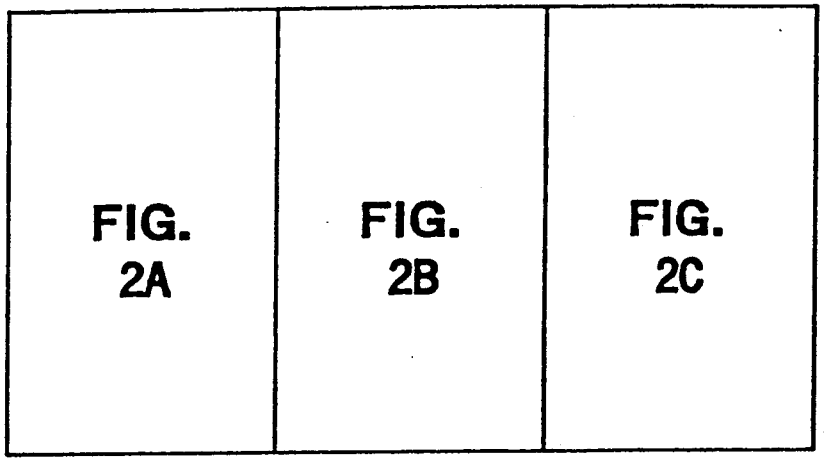
FIG. 1 illustrates the alignment of FIGS. 2A, 2B and 2C.
Figure 2A:
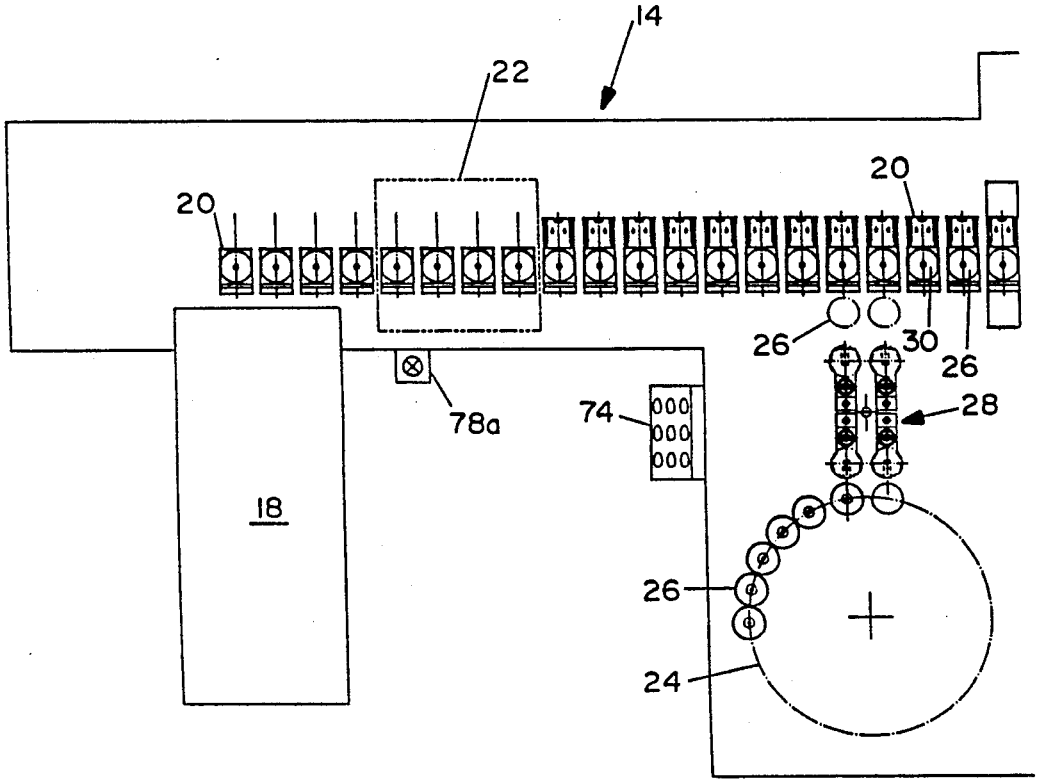
FIGS. 2A, 2B and 2C illustrate a plan view of a compact disc packager.
Figure 2B:
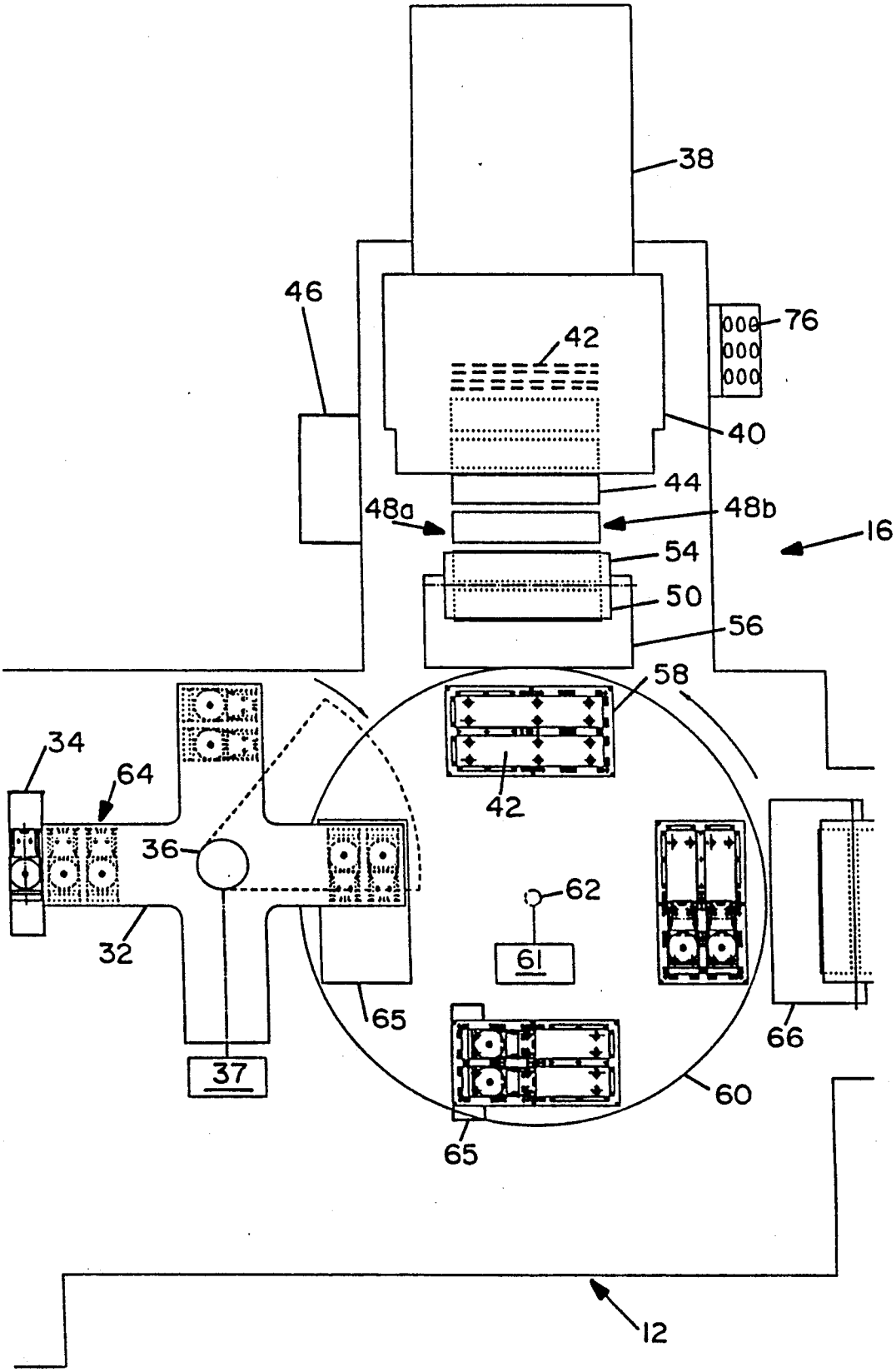
Figure 2C:
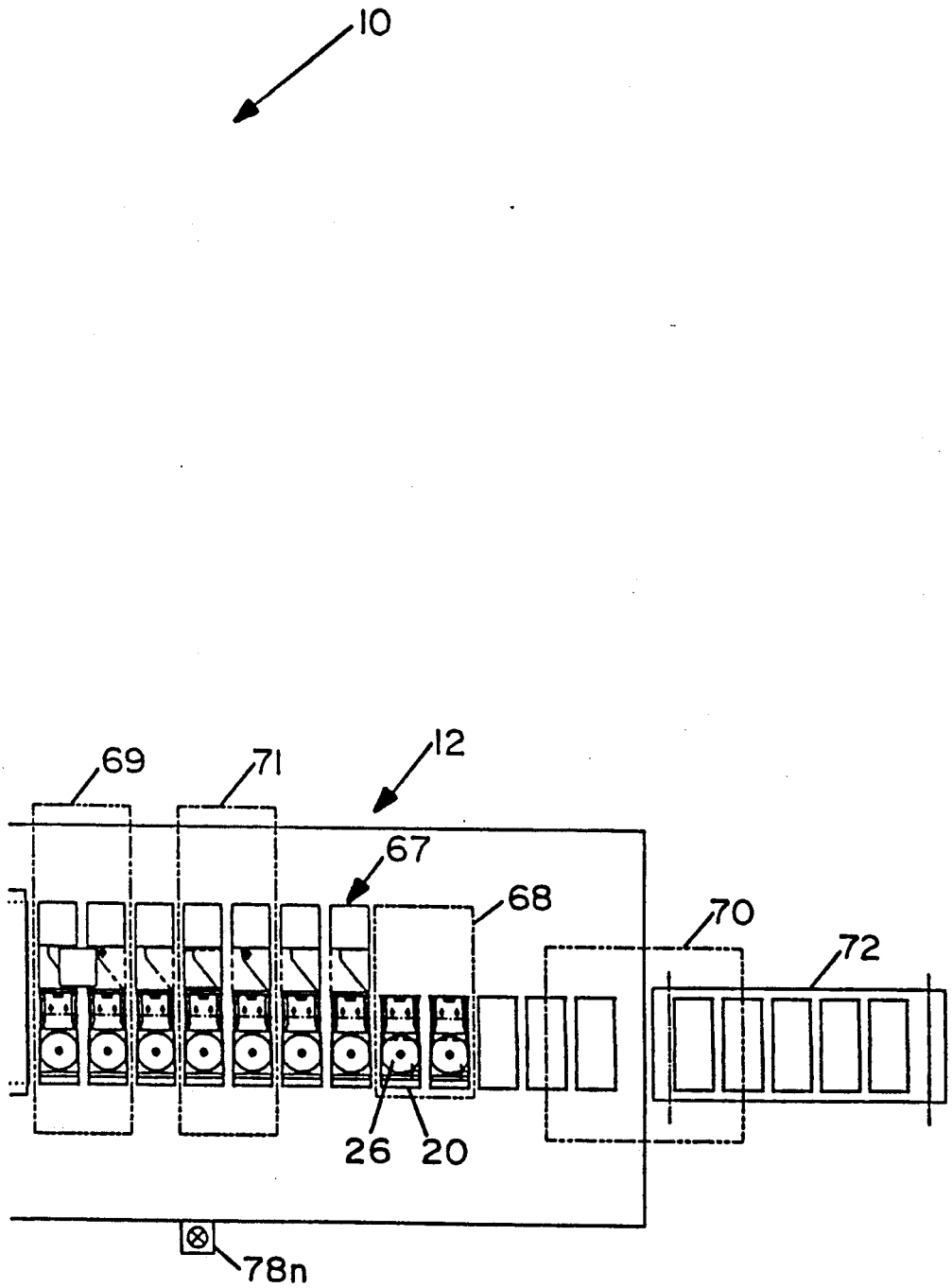

FIG. 1 illustrates the alignment of FIGS. 2A, 2B and 2C.

FIGS. 2A, 2B, and 2C illustrate a plan view of a compact disc or media packager 10, including processing components mounted and secured on a central table 12. A disc base conveyor table 14, and sleeve and literature conveyor table 16 align with the central table 12, preferably at right angles, for delivering compact discs (CDs), booklet literature and disc bases to the central table 12 for rapid packaging.

A disc base placer 18 aligns with and places plastic disc bases 20 on the disc base conveyor table 14, which are conveyed toward the central table 12. A disc base opening mechanism 22 aligns to open the disc bases 20 for subsequent accommodation of compact discs. A circular revolving compact disc spindle table 24 aligns a plurality of compact discs 26 on spindles with a servo controlled CD handling system 28 which places CDs 26, two or more at a time, into the circular cavities 30 of the opened disc bases 20. Plastic disc bases 20 with the compact discs 26 are conveyed on the disc base conveyor table 14 and placed on a first rotary table 32 in sets of at least two by a placer 34. First rotary table 32 is rotatably mounted on the central table 12, and pivots about a center 36 and is turned by a motor 37.

The sleeve and literature conveyor table 16 conveys assembled sleeves with booklets to the central table 12 for placement on the disc bases 20 containing the CDs 26. The sleeve and literature conveyor table 16 includes a sleeve hopper 38 and placer 40, which places sleeves 42 from the sleeve hopper 38 into conveyed trays 44. A glue system 46 applies glue through a plurality of orifices **48*a*–48*b* to appropriate surfaces of the sleeves 42. A rotary placer 50 places booklets from a friction feeder 54 on the glue-laden sleeve 42. The sleeves 42, with the glued on booklets, are conveyed to a placer 56 where they are placed two or more at a time into trays 58 on a central rotary table 60**.

The central rotary table 60, powered by a motor 61, rotates about a center 62 and lies in a plane under the first rotary table 32 containing the semi-packaged CDs. A placer 64 on the under side of each arm of the rotary table places the CD disc bases 20, preferably in sets of at least two, onto the sleeves 42 in the trays 58 on the central rotary table 60.

A clip and reject station 65 aligns over the end of the CD trays as illustrated on the central rotary table 60. The clip and reject station 65 breaks end caps off of disc bases 20 in the case where the disc base 20 is molded with such removable end caps. Another placer 66 places the assembled disc base 20, the CD 26, and the sleeve 42 onto a main table conveyor 67. Booklet placers 69 and 71 place booklets into pouches in the sleeve 42. A sleeve folding mechanism 68 appropriately folds the remaining portion of the package over the CD 26 and the top of the disc base 20. A discharge pick and place conveyor 70 aligns at the end of the main table conveyor 67. A discharge pick and place conveyor 72 also aligns with the main table conveyor 67. Control panels 74 and 76 and a plurality of emergency stop switches **78*a*–78*n* are located at the strategic points of the compact disc packager 10**.

DESCRIPTION OF AN ALTERNATIVE EMBODIMENT

Figure 3:
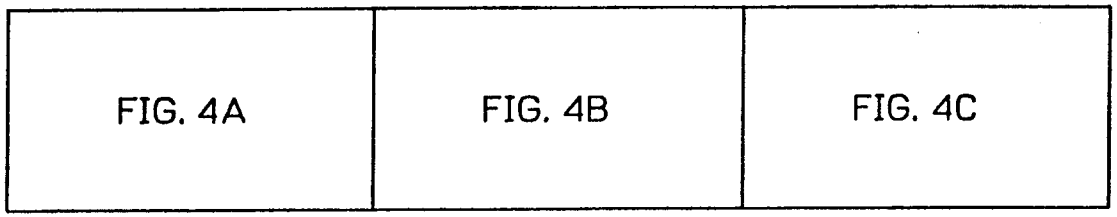
FIG. 3 illustrates the alignment of FIGS. 3A, 3B and 3C.
Figure 4A:
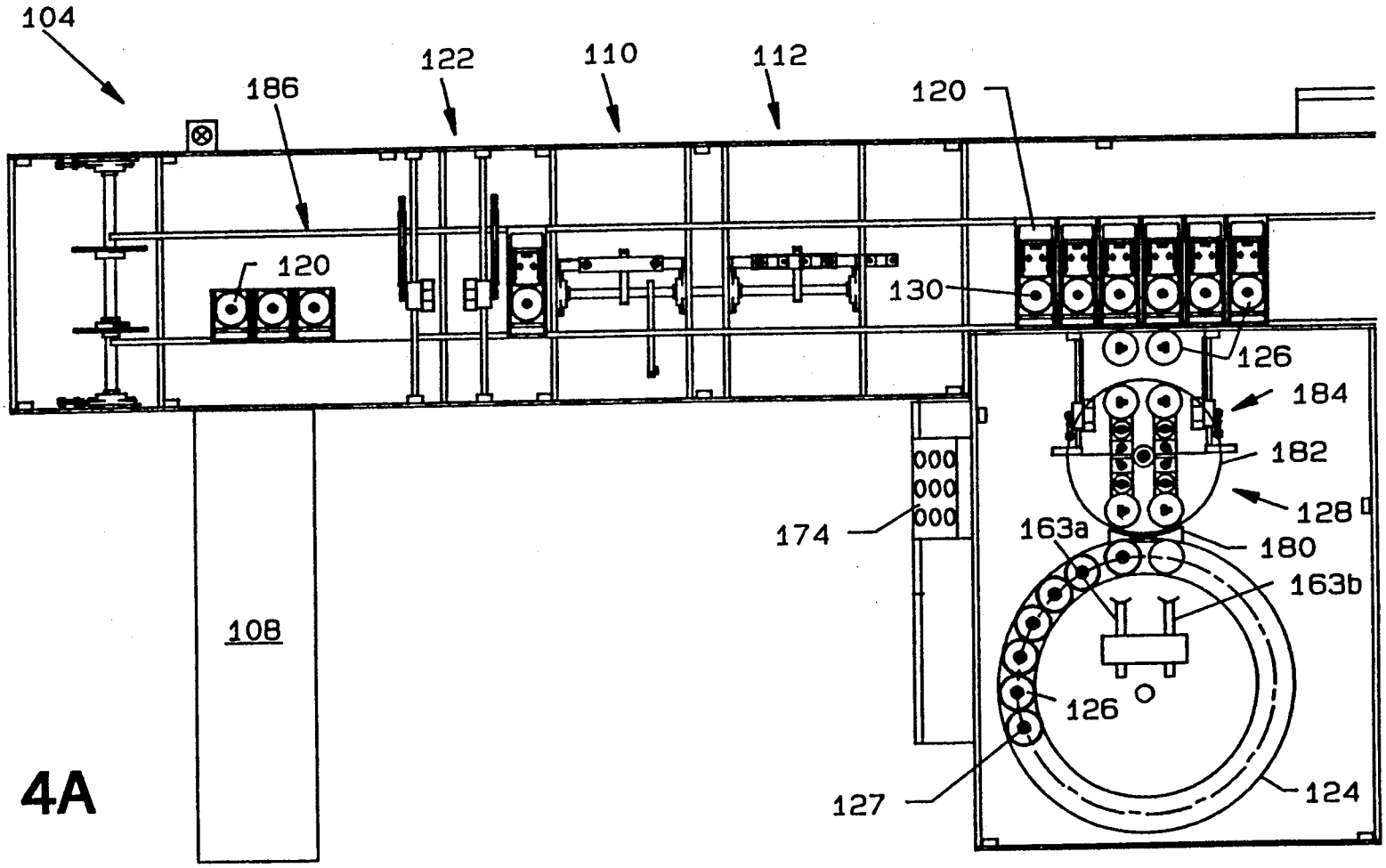
FIGS. 4A, 4B and 4C, an alternative embodiment, collectively illustrates a plan view of a compact disc packager.
Figure 4B:
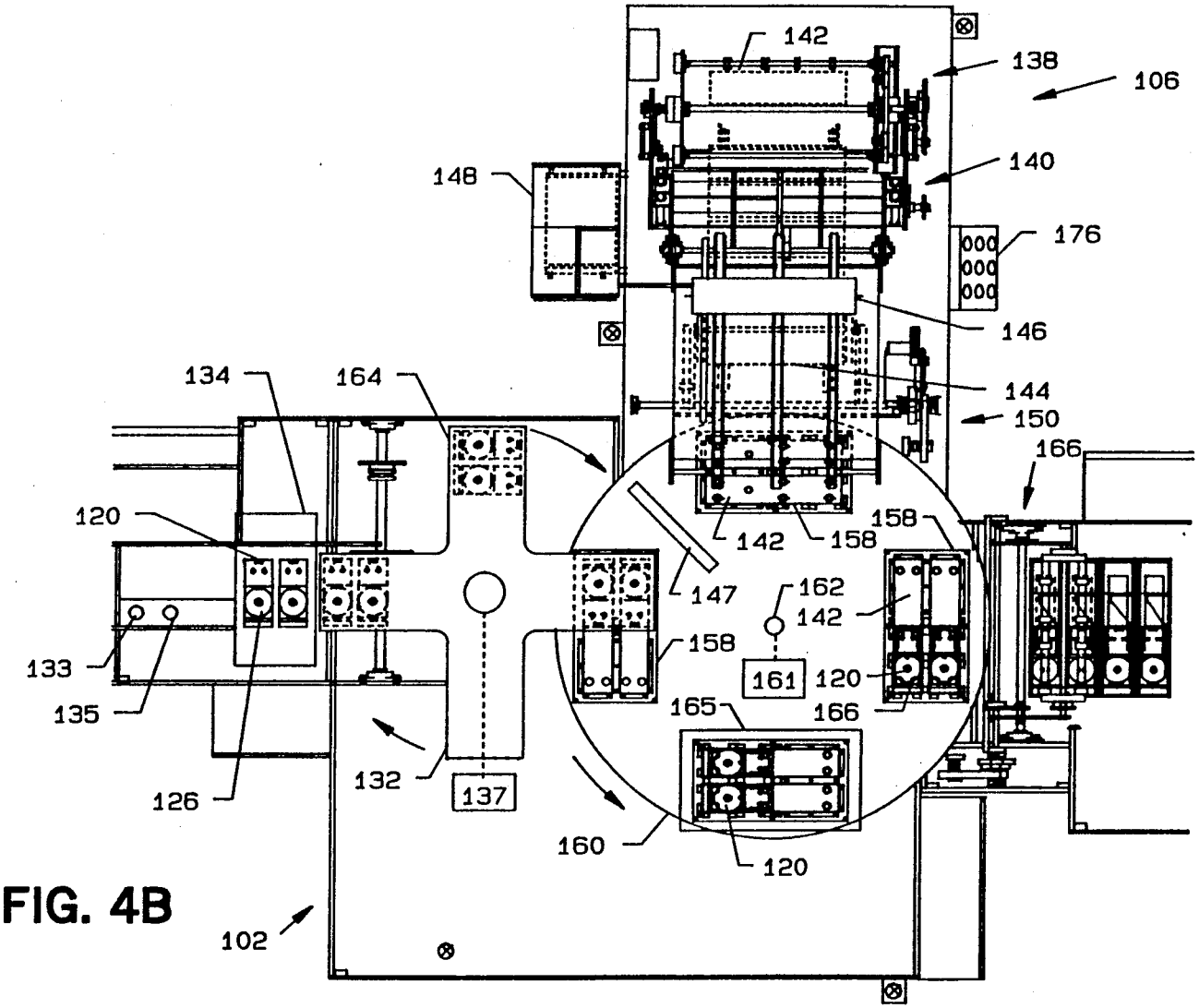
Figure 4C:
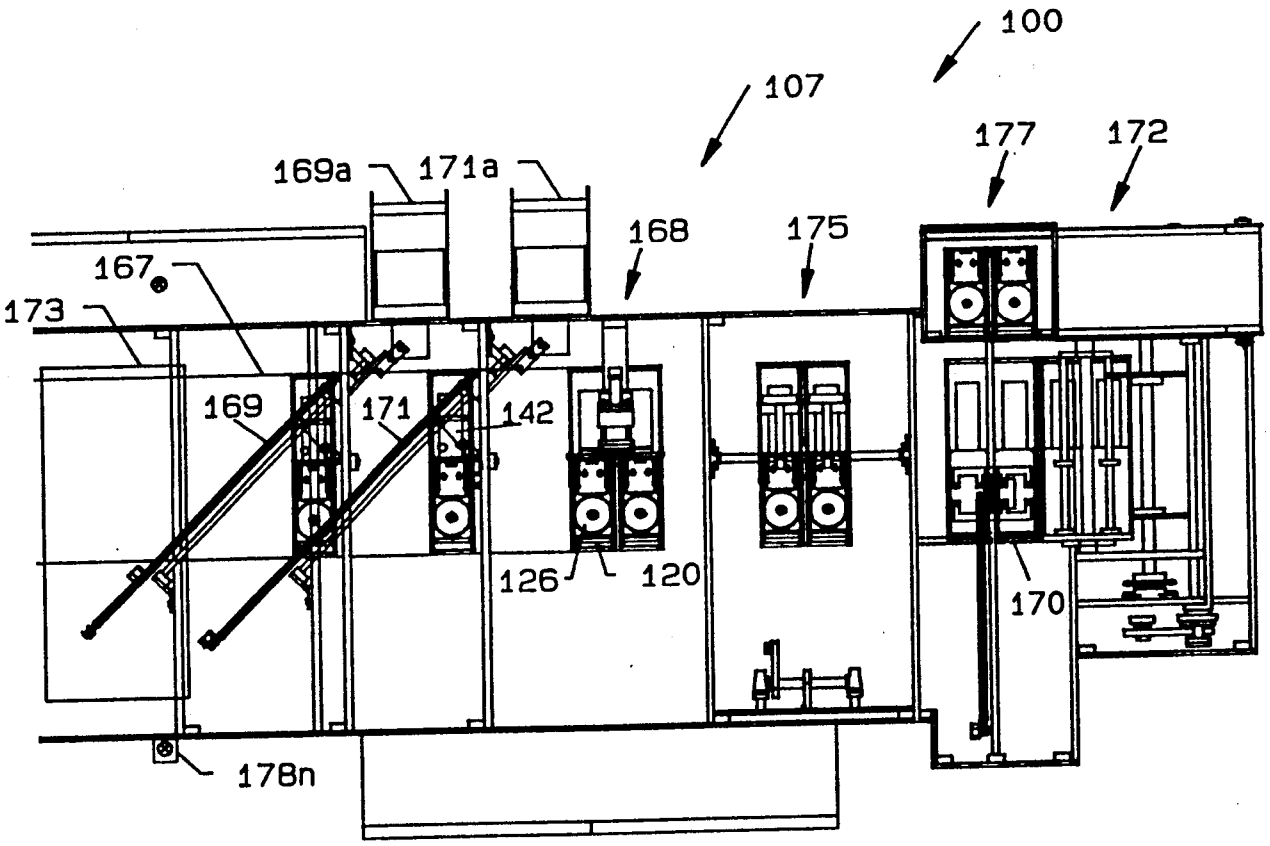

FIG. 3 illustrates the alignment of FIGS. 4A, 4B and 4C.

FIGS. 4A, 4B, and 4C combine to illustrate an alternative embodiment in plan view of a compact disc or media packager 100, including processing components mounted and secured on a central table 102. A disc base conveyor table 104, and sleeve hopper and placer table 106 and a final assembly conveyor table 107 align with the central table 102, preferably at right angles, for delivering compact discs (CDs), booklet literature and disc bases to the central table 102 for rapid packaging.

A disc base placer 108 aligns with and places plastic disc bases 120 on the disc base conveyor table 104, which are conveyed toward the central table 102. A disc base opening mechanism 122 aligns to the disc base tables 104 to open the disc bases 120 for placement on sleeves. Tab operator mechanisms 110 and 112 aligned across the disc base conveyor table 104 to flex and wear in live hinge and to over bend tab members located in the plastic disc base 120. A circular revolving compact disc spindle table 124 aligns a plurality of stacked compact discs 126 on spindles 127 with a servo controlled CD handling system 128 which places CDs 126, one or more at a time into the circular cavities 130 of the opened disc bases 120. A set of pusher bars 163*a* and 163*b* align in the area of the spindle table 124 to push spindles of stacked CDs 127 across an intermediate vertically positionable platform 180 between the spindle table 124 and the servo controlled CD handling system 128. The servo controlled CD handling system 128 includes a rotary table 182 which progressively rotates 180° when the CD stacks are depleted so that a CD pick and place mechanism 184 can be fed, thus allowing CDs to be stacked adjacent to the conveyor system 186 leading to the central table 102. The servo controlled CD handling system then places CDs into the circular cavities 130 of the opened disc bases 120. Plastic disc bases 120 with the compact discs 126 are conveyed on the disc base conveyor table 104 and placed on a first rotary table 132 in sets of at least two by a placer 134. First rotary table 132 is rotatably mounted on the central table 102, and pivots about a center 136 and is turned by a motor 137. Sensors 133 and 135 are located prior to the first rotary table 132 to detect proper placement of a compact disc 126 on the spindle of a disc base 120.

The sleeve conveyor table 106 conveys assembled sleeves to the central table 102 for placement on the disc bases 120 containing the CDs 126. The sleeve conveyor table 106 includes a sleeve hopper 138 and placer 140, which places sleeves 142 from the sleeve hopper 138 into conveyed trays 144. A glue gun 146 having a glue tank 148 applies hot melt glue to a sleeve 142 as the sleeves 142 pass by in the conveyed trays 144. A reciprocating placer 150 positions sleeves 142 from the conveyed trays 144 onto the trays 158.

The central rotary table 160, powered by a motor 161, rotates about a center 162 and lies in a plane under the first rotary table 132 containing the semi-packaged CDs. A placer 164 on the under side of each arm of the rotary table 132 places the CD disc bases 120, preferably in sets of at least two, onto the glue laden sleeves 142 in the trays 158 on the central rotary table 160. An optional glue gun 147 can be placed over the central rotary table 160 as illustrated to apply hot melt glue to a sleeve 142 as it is advanced in a counter clockwise direction by the table 160. A hot melt glue tank 148 supplies glue to the glue gun 146 or optional glue gun 147.

A compression station 165 aligns over the end of the CD trays as illustrated on the central rotary table 160. The compression station 165 compresses the sleeve 142 and disc base 120 to assure glue contact and to insure proper overbend of tab members in the disc base 120. Another placer 166 places the assembled disc base 120, the CD 126, and the sleeve 142 onto a final assembly conveyor 167. A rotary placer 173 places printed material, such as promotional, instructional, or any other materials, onto the sleeve disc combination as they are advanced along the conveyor 167. Booklet placers 169 and 171, having hoppers 169*a* and 171*a*, place booklets into pouches in the sleeve 142. A sleeve fold start mechanism 168 and a fold finish mechanism 175 appropriately fold the remaining portion of the package over the CD 126 and the top of the disc base 120. A pick and place mechanism 177 is located at the end of the main table conveyor 167 adjacent to small conveyor 170 for transfer of sleeves and their contents from the conveyor 170 to the discharge conveyor 172. Rejected sleeves continue along the conveyor 170 and are not picked up and placed by the pick and place mechanism 177 and are subsequently conveyed off the final assembly conveyor table 107 for disposal. Control panels 174 and 176 and a plurality of emergency stop switches 178*a*–178*n* are located at the strategic points of the compact disc packager 100.

Various modifications can be made to the present invention without departing from the apparent scope hereof.

We claim:

1. Apparatus for assembling compact disc packages comprising:

a. a central table;
b. a disc base conveyor table;
c. a sleeve hopper and placer table;
d. a final assembly conveyor table;
e. a disc base opening mechanism on said disc base conveyor table;
f. one or more tab operator mechanisms on said disc base conveyor table for flexing of live hinges and tab members;
g. a circular revolving compact disc spindle table having a plurality of stacked compact discs on a plurality of spindles;
h. a servo controlled CD handling system for placement of one or more CDs at a time into opened disc bases;
i. a positionable platform between said circular revolving compact disc spindle table and said servo controlled CD handling system;
j. said servo controlled CD handling system having a rotary table for rotating CD stacks 180°;
k. a CD pick and place mechanism for transporting one or more CDs from said rotary table to opened disc bases;
l. placement sensors for detection of proper placement of a CD on a disc base spindle;
m. a first generally circular table rotatably mounted on the central table;
n. a second generally circular table rotatably mounted on the central table in a slightly overlapping relationship with the first rotatable table;
o. a tray conveyor aligned for carrying compact disc trays to the central table;
p. placer means for moving compact disc bases from the disc base conveyor to the first table;
q. a sleeve conveyor, a hopper and rotary placer for moving and placing CD album cover sleeves from the sleeve hopper and placer table to the central table and onto glued surfaces of the disc tray;
r. means to rotate the first circular table;
s. means to rotate the second circular table;

t. second placer means for moving compact disc bases from the first table to the first circular table;
u. first circular table means for moving compact disc bases to the sleeves on the second table;
v. a glue means aligned over second circular table
w. a compression station on said central circular table;
x. a placer between said central table and said final assembly conveyor table;
y. a rotary placer for placement of instructional material into the sleeve disc combination along the final assembly conveyor table;
z. one or more booklet placers along the final assembly conveyor table
aa. one or more booklet hoppers along the final assembly conveyor table;
ab. a sleeve fold start mechanism along the final assembly conveyor table;
ac. a sleeve fold finish mechanism along the final assembly conveyor table; and,
ad. a discharge pick and place mechanism and for removing completed assembled sleeves and disc bases from the final assembly conveyor table.

2. The apparatus of claim wherein the first and second rotary tables rotate in opposite directions.

3. Method for assembling plastic compact disc holders comprising:
a. providing a compact disc base having two components slidable relative to each other;
b. opening the disc base;
c. flexing compact disc base hinges;
d. flexing compact disc base tabs;
e. loading compact disc in disc base;
f. transporting compact disc and disc base to a central rotary table;
g. providing a flat cardboard sleeve having distinct portions;
h. applying glue to one distinct portion;
i. applying glue to a second distinct portion;
j. placing flat cardboard sleeve to disc base;
k. compressing flat cardboard sleeve to disc base;
l. transporting disc base, flat cardboard sleeve and compact disc to final assembly conveyor;
m. loading pamphlets onto combined assembly; and,
n. folding sleeve over disc base.

4. The process of claim 3 further comprising breaking a separable end cap from the compact disc base after it is glued to the sleeve.

5. Apparatus for assembling compact disc packages comprising:
a. conveyor means for conveying compact disc bases;
b. disc base placer means for placing compact disc bases having tab members on said conveyor means;
c. means for opening said compact disc bases as they are conveyed on said conveyor means;
d. means for flexing said tab members on said disc bases as they are conveyed on said conveyor means;
e. means for placing compact discs into said disc bases as they are conveyed on said conveyor means;
f. rotary table means for accepting sets of at least two compact disc bases from said conveyor means, said rotary table means being aligned with a central rotary table and rotatingly transporting said disc bases thereto;
g. sleeve conveyor means aligned with said central rotary table for conveying disc sleeves thereto;
h. placer means on the underside of said rotary table means for placing each of said compact disc bases on a respective disc sleeve;
i. compression means on said rotary table means for compressing said sleeve and said disc base together;
j. placer means on said central rotary table for placing said compressed disc bases and sleeves onto final conveyor means;
k. rotary placer means for placing instructional material onto said sleeve disc combination as they are conveyed on said final conveyor means; and,
l. folding means for folding said sleeve over said compact disc as they are conveyed on said final conveyor means.

6. Apparatus of claim 5, further comprising transfer means at the end of said final conveyor means for transferring the packaged compact disc from said final conveyor means to a discharge conveyor.

7. Apparatus of claim 5, wherein said means for placing compact discs into said disc bases as they are conveyed on said conveyor means comprises a circular revolving compact disc spindle table aligned with said conveyor means.

8. Apparatus of claim 7, wherein said means for placing compact discs into said disc bases further comprises a servo controlled compact disc handling system aligned between said circular revolving table and said conveyor means.

9. Apparatus of claim 8, wherein said means for placing compact discs into said disc bases further comprises a plurality of pusher bars for pushing spindles of stacked compact discs on said circular revolving compact disc spindle table across a platform positioned between said circular revolving table and said servo controlled handling system.

10. Apparatus of claim 5, further comprising sensing means on said conveyor means for detecting proper placement of said compact discs on said disc bases.

11. Apparatus of claim 5, wherein said sleeve conveyor means includes a sleeve hopper.

12. Apparatus of claim 5, wherein said sleeve conveyor means includes means for applying adhesive to said sleeves.

13. Apparatus of claim 5, further comprising booklet placement means aligned with said final conveyor means for placing booklets into said sleeves.

14. Apparatus of claim 5, wherein said folding means comprises fold start means and fold finish means.

15. Apparatus of claim 5, wherein said disc bases include hinges, said apparatus further comprising means for flexing said hinges as said disc bases are conveyed on said conveyor means.

* * * * *